US007946456B1

(12) United States Patent
Holloway

(10) Patent No.: US 7,946,456 B1
(45) Date of Patent: May 24, 2011

(54) HAIR BOW MAKER

(76) Inventor: Shelley L. Holloway, LaPorte, TX (US)

( * ) Notice: Subject to any disclaimer, the term of this patent is extended or adjusted under 35 U.S.C. 154(b) by 858 days.

(21) Appl. No.: 11/860,612

(22) Filed: Sep. 25, 2007

Related U.S. Application Data

(60) Provisional application No. 60/909,889, filed on Apr. 3, 2007, provisional application No. 60/847,430, filed on Sep. 26, 2006.

(51) Int. Cl.
*A41H 43/00* (2006.01)

(52) U.S. Cl. ..... 223/46

(58) Field of Classification Search ..... 223/46; 28/147

See application file for complete search history.

(56) References Cited

U.S. PATENT DOCUMENTS 1,598,310 A * 8/1926 Quinlan ..... 289/1.5
1,946,561 A * 2/1934 Widerman ..... 132/277
2,638,908 A * 5/1953 Schildt ..... 132/277
3,949,766 A * 4/1976 Merges ..... 132/277
4,410,113 A * 10/1983 Palombo ..... 223/46
5,473,796 A * 12/1995 Fusillo ..... 24/30.5 R

OTHER PUBLICATIONS

Photographs of a Hair Clip, Photos Taken by Applicant, Shelley L. Holloway, Oct. 11, 2007.

* cited by examiner

*Primary Examiner* — Shaun R Hurley
*Assistant Examiner* — Andrew W Sutton
(74) *Attorney, Agent, or Firm* — Donald J. Ersler

(57) ABSTRACT

A hair bow maker includes a first jaw and a second jaw. The first and second jaws are hinged to each other on one end. A plurality of teeth are formed on an inside surface of the first and second jaws. A first slot is formed through the first jaw and a second slot is formed through the second jaw. An elastic strap is retained in one of the first and second jaws to close the other ends thereof. A second embodiment of the hair bow maker includes a torsion spring, which forces the other ends of the first and second jaws together. A third embodiment of the hair bow maker includes a guide plate extending upward from each end of the first jaw, which receive the second jaw. A fourth embodiment of the hair bow maker includes two jaw members and a flat torsion spring.

16 Claims, 9 Drawing Sheets

FIG, 6a

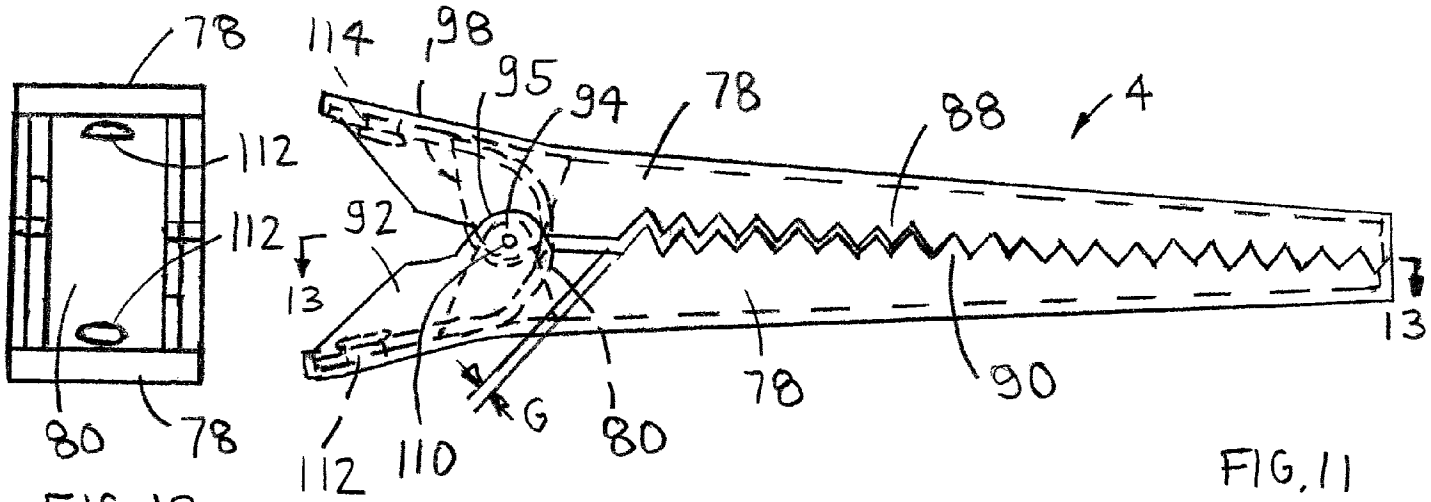
FIG. 11
FIG. 12
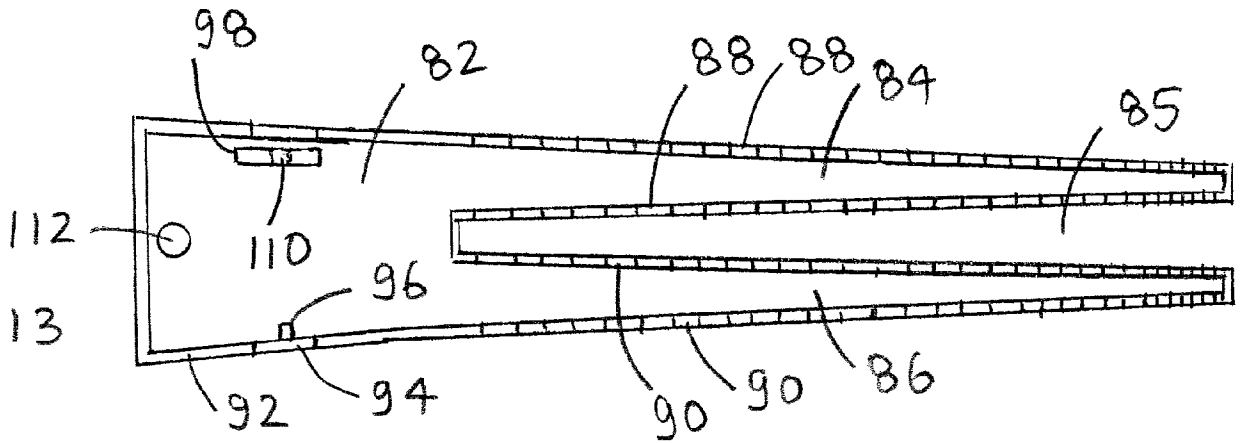
FIG. 13

HAIR BOW MAKER

CROSS-REFERENCES TO RELATED APPLICATIONS

This is a utility patent application taking priority from provisional application No. 60/847,430 filed on Sep. 26, 2006 and provisional application No. 60/909,889 filed on Apr. 3, 2007.

BACKGROUND OF THE INVENTION

1. Field of Invention

The present invention relates generally to hair accessory products and more specifically to a hair bow maker, which improves the ease, professionalism and speed for crimping hair bows.

2. Description of Prior Art

In an attempt to reduce the cost of providing children and pets with hair bows, produce color or clothing specific hair accessories otherwise not available, or as a work from home income generating tool; a vastly expanding number of individuals are making their own hair bows. However, bringing the center line of a bow to a perfect crimped and even point requires skill and experience. Further it appears that there are no devices available for the crimping and pointing of the ribbon to create a perfect center line in hair bow production.

Accordingly, there is a clearly felt need in the art for a hair bow maker, which provides a perfect center line crimp and point to a user of any skill level, and interacts with a wide variety of ribbon types used in the production of hair bows.

SUMMARY OF THE INVENTION

The present invention provides a hair bow maker, which improves the ease, professionalism and speed for crimping hair bows. The hair bow maker includes a first jaw and a second jaw. The first and second jaws are preferably pivotally engaged with each other on one end with a hinge. A plurality of first teeth are formed on an inside surface of the first jaw and a plurality of second teeth are formed on an inside surface of the second jaw.

The plurality of first and second teeth are aligned to receive each other. The first and second teeth may be replaced with first and second flat surfaces. A first slot is formed through the first jaw, starting at the other end thereof and continuing to substantially the one end. A second slot is formed through the second jaw, starting at the other end thereof and continuing to substantially the one end. An elastic strap is retained in one of the first or second jaws to close the other ends thereof, after insertion of a folded ribbon.

A second embodiment of the hair bow maker includes a first jaw and a second jaw. One end of the first jaw is pivotally engaged to one end of the second jaw. A torsion spring is used to close the other ends of the first and second jaws. A third embodiment of the hair bow maker includes a first jaw and a second jaw. The first jaw includes at least one guide plate extending upward from each end, which is sized to receive the second jaw. An elastic strap is retained on each end in one of the first or second jaws to force the first jaw against the second jaw. A fourth embodiment of the hair bow maker includes two jaw members and a flat torsion spring. The two jaw members are identical. One end of one of the two jaw members is pivotally engaged to one end of the other jaw member. A flat torsion spring is used to close the other ends of the two jaw members.

In use, a folded ribbon is inserted into the hair bow maker. The first and second jaws are brought together and secured to each other on the other ends with the elastic strap. The plurality of first and second teeth create a creasing pattern in the folded ribbon and also clamp the folded ribbon. The closed hair bow maker creates a fold pattern and center line point for the folded ribbon, which allows a user to properly secure the center line with tie-off material and perfectly crease the folded ribbon. The completed bow is then removed from the hair bow maker by removing the elastic strap and separating the first and second jaws.

Accordingly, it is an object of the present invention to provide a hair bow maker, which provides a perfect center line crimp and point to a user of any skill level.

Finally, it is another object of the present invention to provide a hair bow maker, which interacts with a wide variety of ribbon types used in the production of hair bows.

These and additional objects, advantages, features and benefits of the present invention will become apparent from the following specification.

BRIEF DESCRIPTION OF THE DRAWINGS

FIG. 6*a* is a side view of a second embodiment of a hair bow maker without first and second teeth in accordance with the present invention.

FIG. 11 is a side view of a fourth embodiment of a hair bow maker in accordance with the present invention.

FIG. 12 is an end view of a fourth embodiment of a hair bow maker in accordance with the present invention.

FIG. 13 is an inside top view of a jaw member of a fourth embodiment of a hair bow maker in accordance with the present invention.

DETAILED DESCRIPTION OF THE PREFERRED EMBODIMENTS

Figure 1:
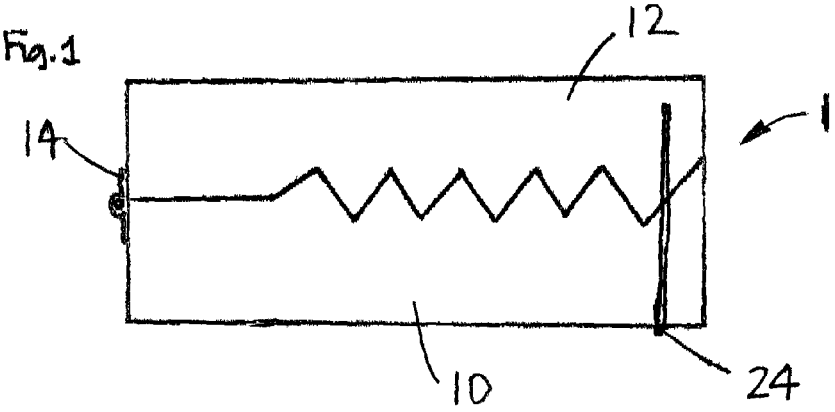
FIG. 1 is a side view of a hair bow maker in accordance with the present invention.
Figure 2:
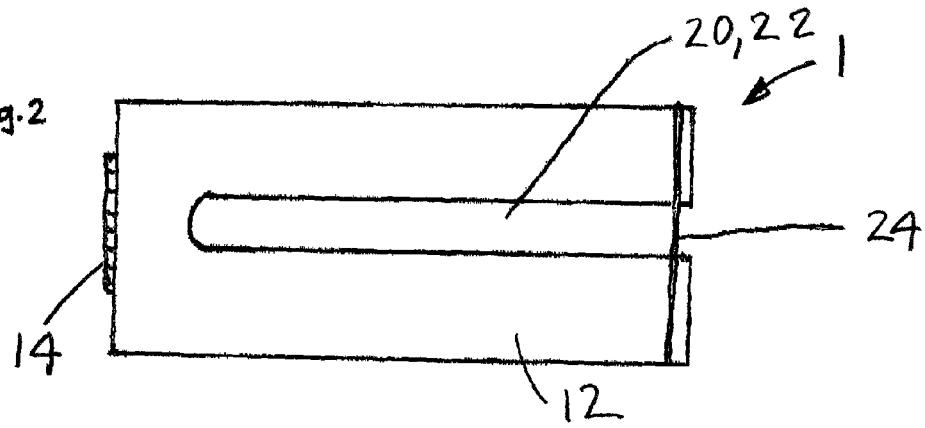
FIG. 2 is a top view of a hair bow maker in accordance with the present invention.
Figure 3:
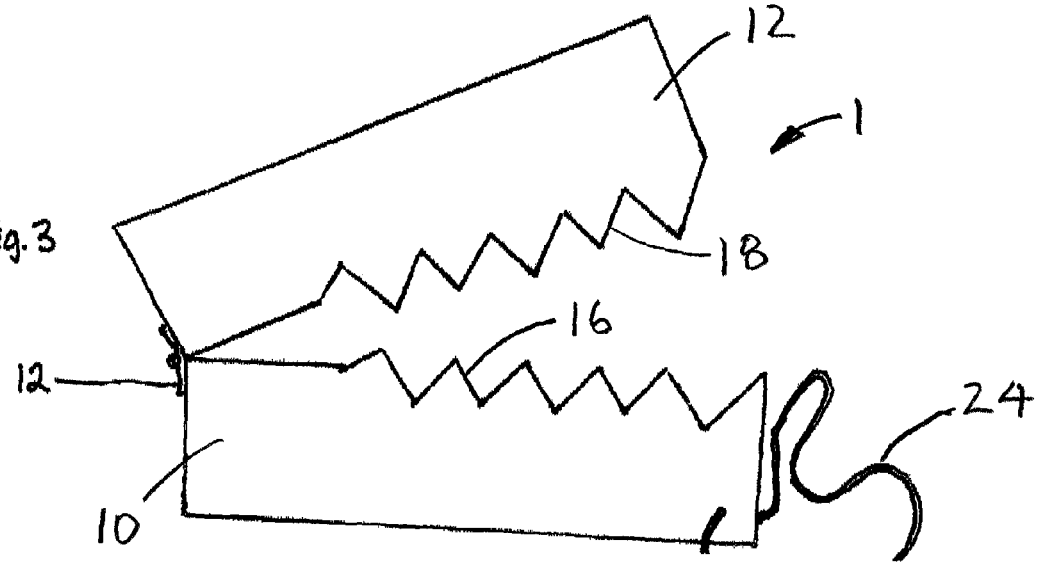
FIG. 3 is a side view of a hair bow maker with first and second jaws separated for receiving a folded ribbon in accordance with the present invention.

With reference now to the drawings, and particularly to FIG. 1, there is shown a side view of a hair bow maker 1. With reference to FIGS. 2-3, the hair bow maker 1 includes a first jaw 10 and a second jaw 12. The first and second jaws may be fabricated from any suitable material. The first and second jaws are preferably pivotally engaged with each other on one end with a hinge 14, but other methods may also be used. The hinge 14 is attached to the first and second jaws with fasteners or the like.

Figure 1A:
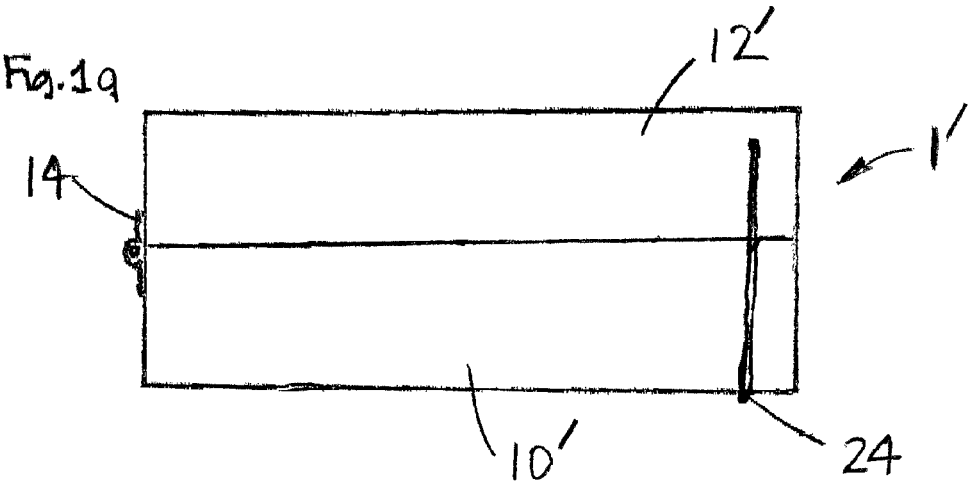
FIG. 1*a* is a side view of a hair bow maker without first and second teeth in accordance with the present invention.
Figure 1A:
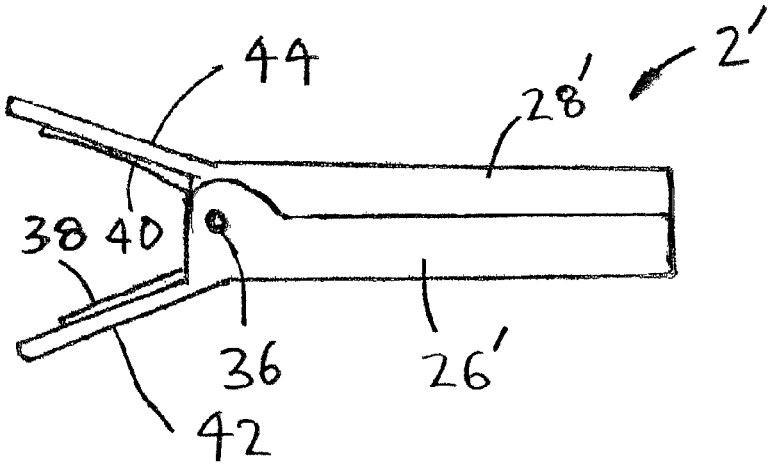

A plurality of first teeth 16 are formed on an inside surface of the first jaw 10 and a plurality of second teeth 18 are formed on an inside surface of the second jaw 12. The plurality of first and second teeth are aligned to receive each other. The plurality of teeth are disclosed as having a triangular shape, but could be any other appropriate shape. A low friction coating may be applied to the plurality of first and secondary teeth to allow a folded ribbon to be pulled therethrough with greater ease. With reference to FIG. 1*a*, flat surfaces may be formed on an inside surface of the first jaw 10' and the second jaw 12' of the hair bow maker 1' instead of the first and second teeth.

A first slot 20 is formed through the first jaw 10, starting at the other end thereof and continuing to substantially the one end. A second slot 22 is formed through the second jaw 12, starting at the other end thereof and continuing to substantially the one end. An elastic strap 24 is retained in one of the first or second jaws to close the other ends thereof, after insertion of a folded ribbon. However, other methods of keeping the first and second jaws together may also be used, besides the elastic strap 24.

Figure 6:
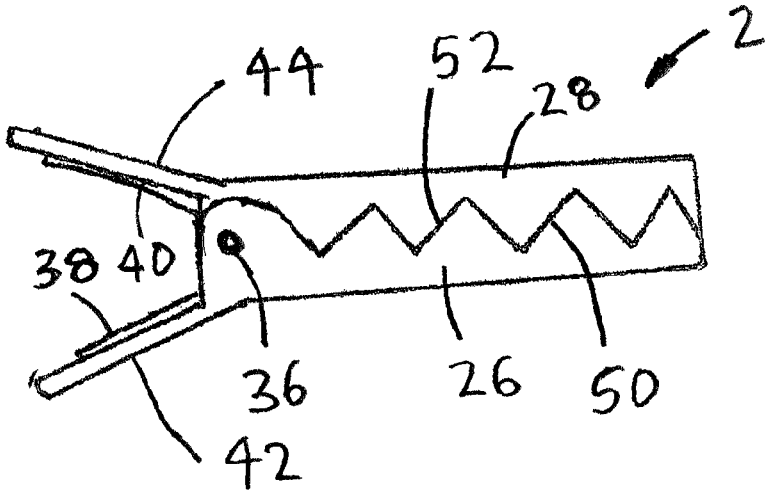
FIG. 6 is a side view of a second embodiment of a hair bow maker in accordance with the present invention.
Figure 7:
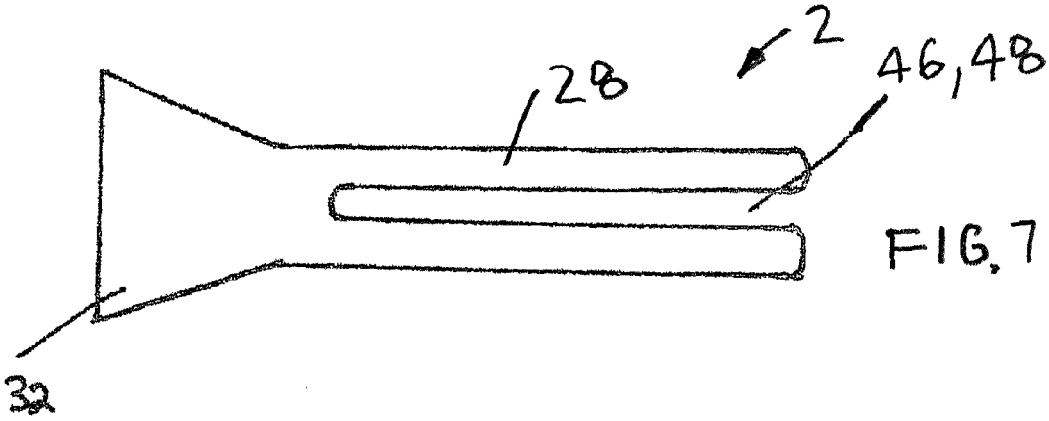
FIG. 7 is a top view of a second embodiment of a hair bow maker in accordance with the present invention.
Figure 8:
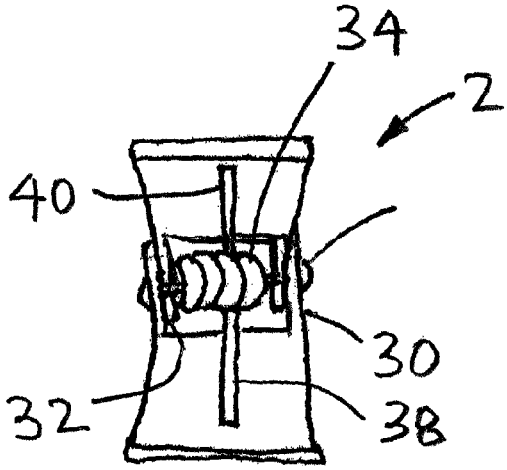
FIG. 8 is an end view of a third embodiment of a hair bow maker in accordance with the present invention.

With reference to FIGS. 6-8, a second embodiment of the hair bow maker 2 is shown. The hair bow maker 2 includes a first jaw 26 and a second jaw 28. The first and second jaws may be fabricated from any suitable material. A pair of first pivot tabs 30 extend from one end of the first jaw 26 and a pair of second pivot tabs 32 extend from one end of the second jaw 28. A torsion spring 34 is retained between the first and second pivot tabs by inserting of a retention pin 36 through the first and second pivot tabs. The torsion spring 34 includes a first spring end 38 and a second spring end 40. A first finger tab 42 extends from the one end of the first jaw 26 and a second finger 44 extends from the one end of the second jaw 28. The first spring end 38 contacts an inside surface of the first finger tab 42 and the second spring end 40 contacts an inside surface of the second finger tab 44 to force the other ends of the first and second jaws together.

A first slot 46 is formed through the first jaw 26, starting at the other end thereof and continuing to substantially the one end. A second slot 48 is formed through the second jaw 28, starting at the other end thereof and continuing to substantially the one end. A plurality of first teeth 50 are formed on an inside surface of the first jaw 28 and a plurality of second teeth 52 are formed on an inside surface of the second jaw 28. The plurality of first and second teeth are aligned to receive each other. The plurality of teeth are disclosed as having a triangular shape, but could be any other appropriate shape. A low friction coating may be applied to the plurality of first and secondary teeth to allow a ribbon to be pulled therethrough with greater ease. With reference to FIG. 6*a*, flat surfaces may be formed on an inside surface of the first jaw 26' and the second jaw 28' of the hair bow maker 2' instead of the first and second teeth.

Figure 9:
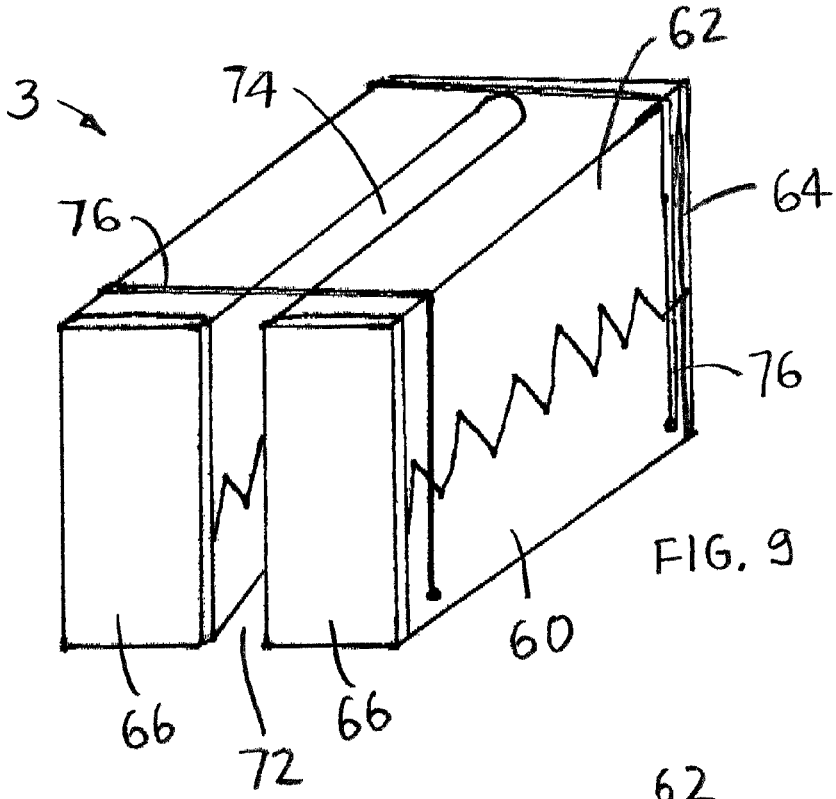
FIG. 9 is a perspective view of a third embodiment of a hair bow maker in accordance with the present invention.
Figure 10:
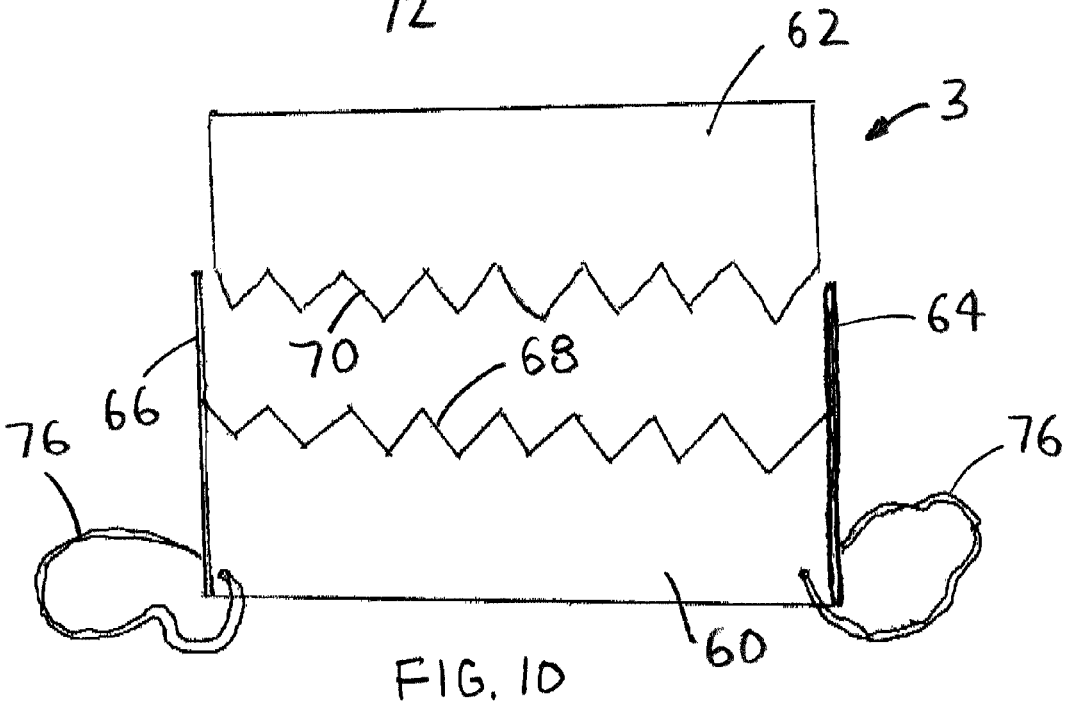
FIG. 10 is a side view of a third embodiment of a hair bow maker with the first and second jaws separated in accordance with the present invention.
Figure 9A:
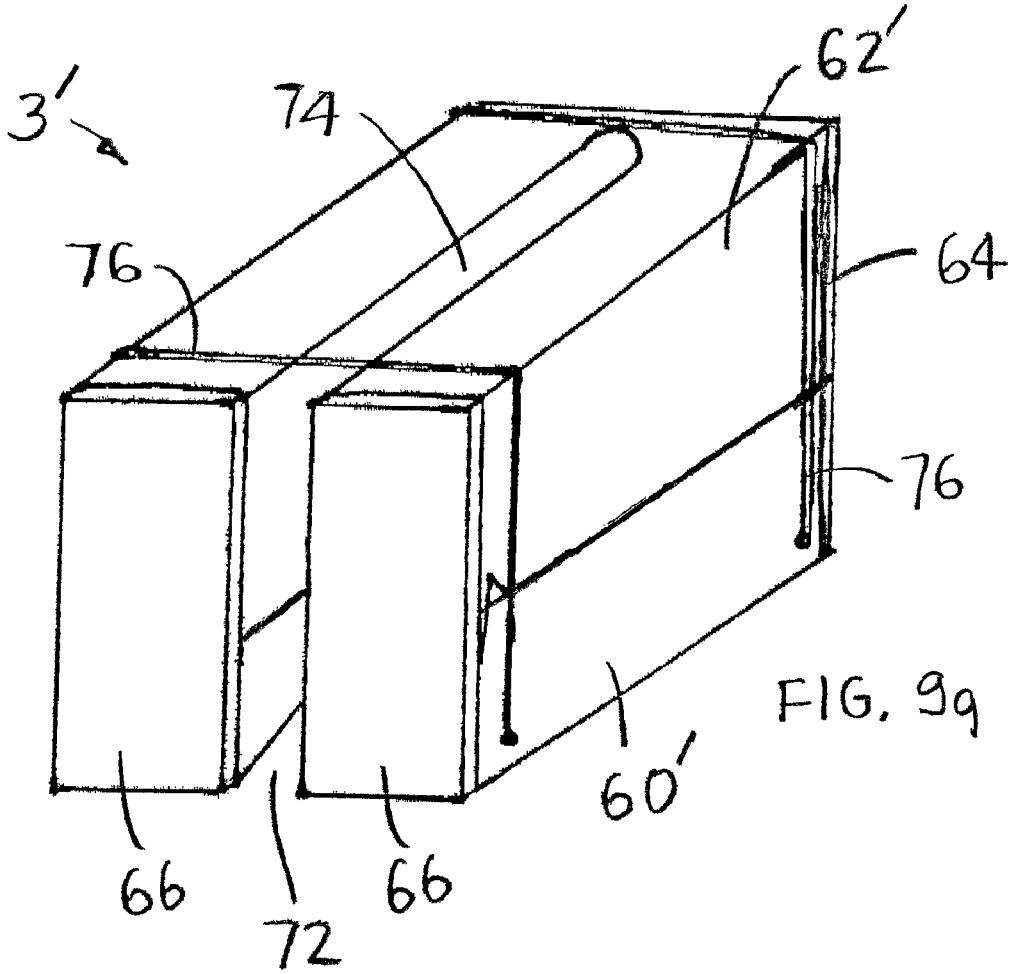
FIG. 9*a* is a perspective view of a third embodiment of a hair bow maker without first and second teeth in accordance with the present invention.
Figure 14:
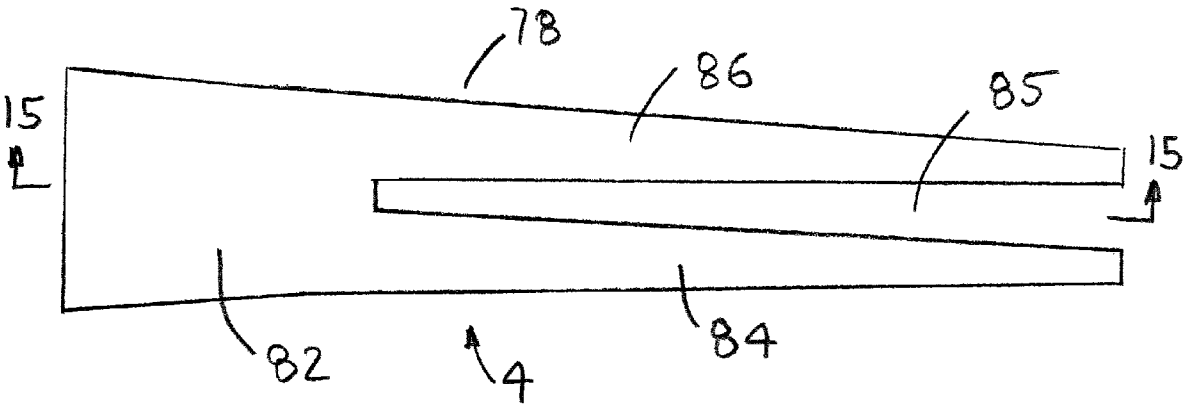
FIG. 14 is a top view of a fourth embodiment of a hair bow maker in accordance with the present invention.
Figure 15:
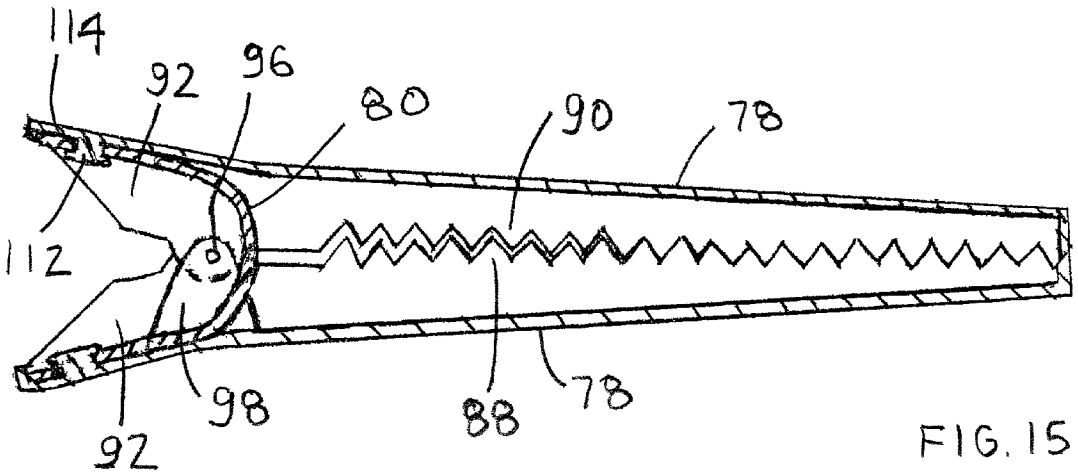
FIG. 15 is a side cross sectional view of a fourth embodiment of a hair bow maker cut through FIG. 14 in accordance with the present invention.

With reference to FIGS. 9-10, a third embodiment of a hair bow maker 3 includes a first jaw 60 and a second jaw 62. The first and second jaws may be fabricated from any suitable material. The second jaw 62 is slidably engaged with the first jaw 60 through a first guide plate 64 secured to one end of the first jaw 60 and a pair of second guide plate 66 secured to the other end of the first jaw 60. A plurality of first teeth 68 are formed on an inside surface of the first jaw 60 and a plurality of second teeth 70 are formed on an inside surface of the second jaw 62. The plurality of first and second teeth are aligned to receive each other. The plurality of teeth are disclosed as having a triangular shape, but could be any other appropriate shape. A low friction coating may be applied to the plurality of first and secondary teeth to allow a ribbon to be pulled therethrough with greater ease. With reference to FIG. 9*a*, flat surfaces may be formed on an inside surface of the first jaw 60' and the second jaw 62' of the hair bow maker 2' instead of the first and second teeth.

A first slot 72 is formed through the first jaw 60, starting at the other end thereof and continuing to the one end. A second slot 74 is formed through the second jaw 62, starting at the other end thereof and continuing to the one end. An elastic strap 76 is retained on each end in one of the first and second jaws to force the first jaw 60 against the second jaw 62. However, other methods of keeping the first and second jaws together may also be used, besides the elastic strap 76.

Figure 4:
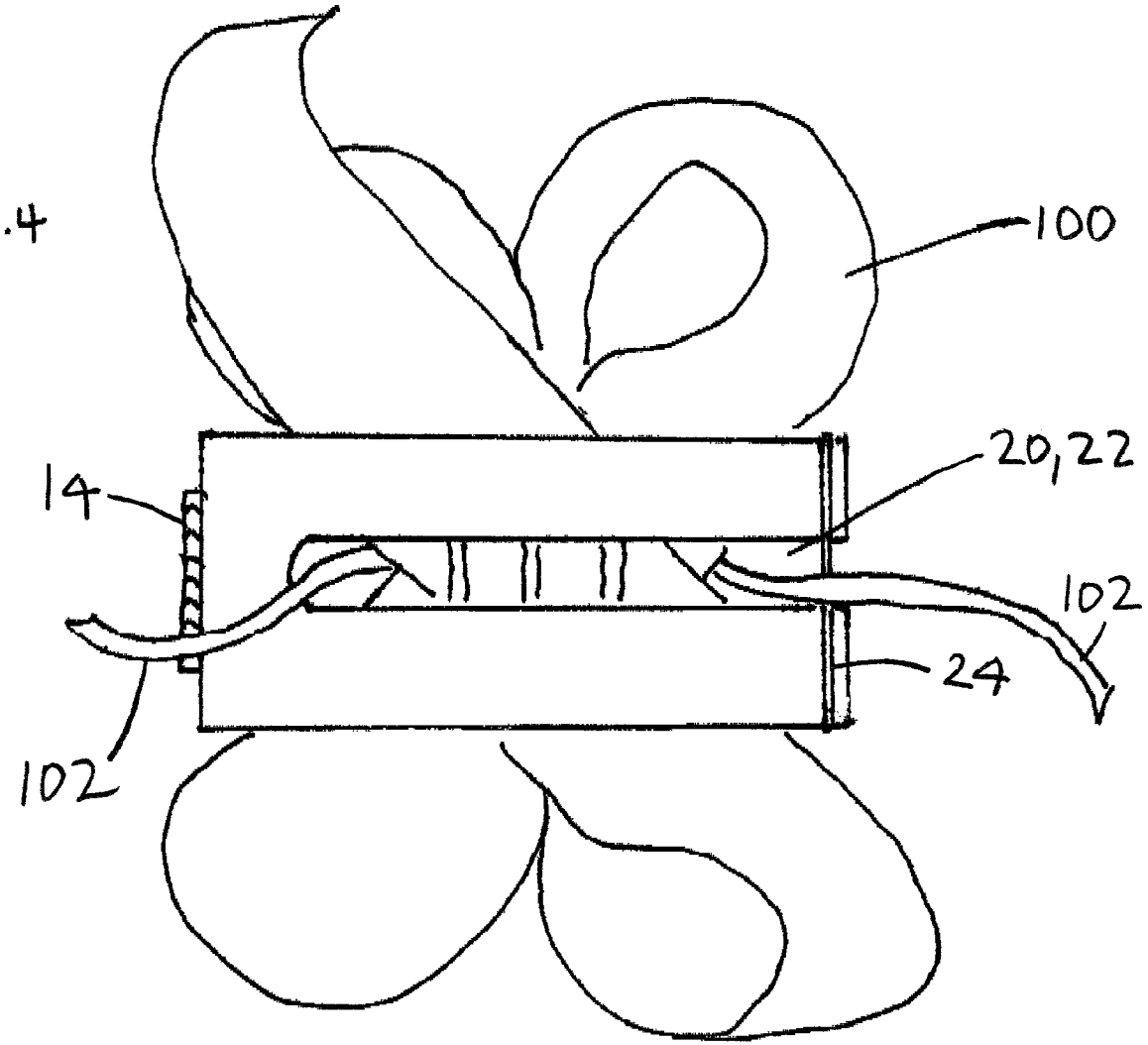
FIG. 4 is a top view of a hair bow maker after the insertion of a folded ribbon in accordance with the present invention.
Figure 5:
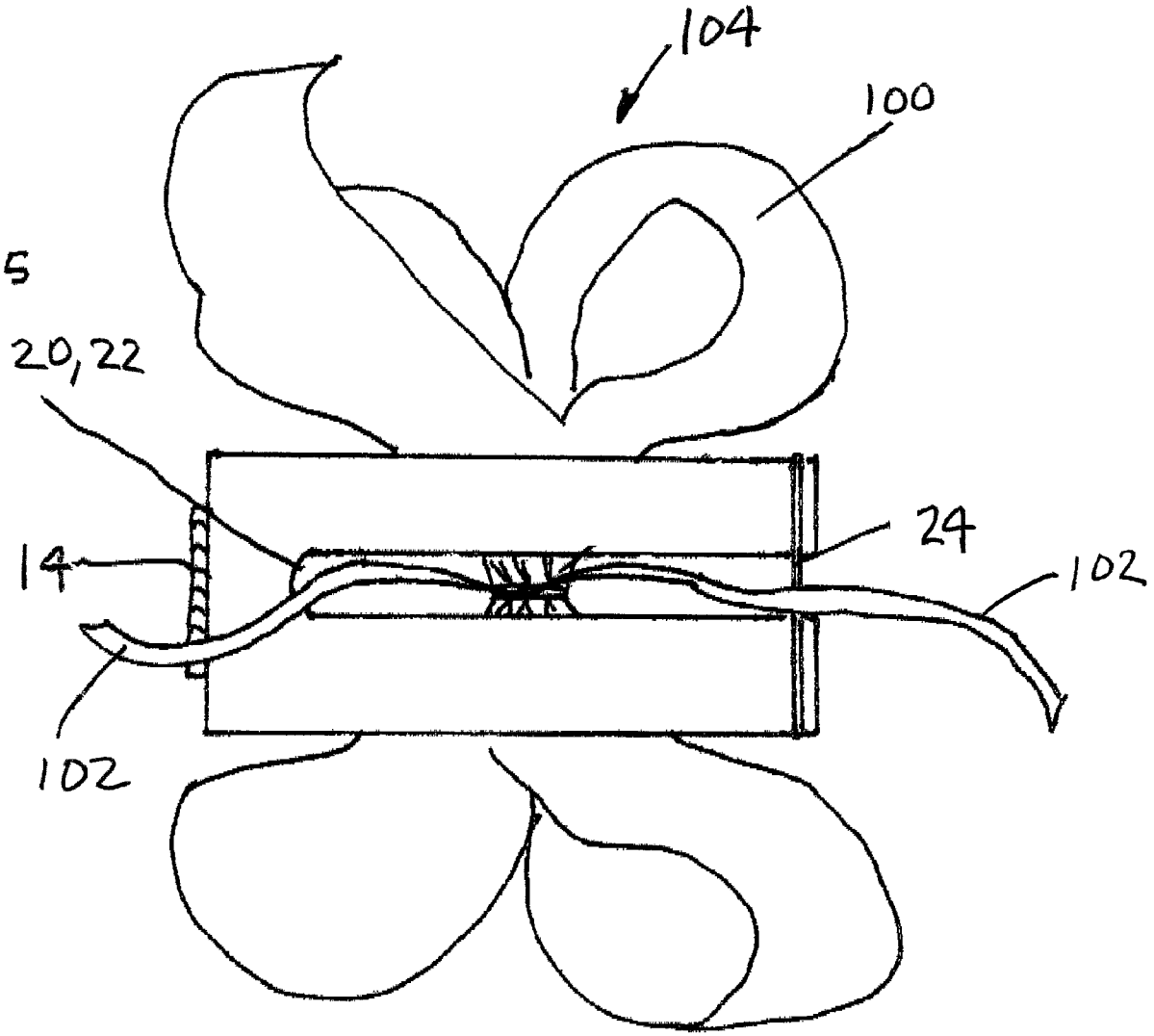
FIG. 5 is a top view of a hair bow maker after a folded ribbon has been tied in accordance with the present invention.

With reference to FIGS. 4-5, a folded ribbon 100 is inserted into the hair bow maker 1. The first and second jaws are brought together and secured to each other on the other ends with the elastic strap 24. The plurality of first and second teeth create a creasing pattern in the folded ribbon 100 and also clamp the folded ribbon 100. The folded ribbon 100 may be stabilized, before insertion into the hair bow maker 1 with forceps, tweezers, bobbie pins, clips or the like. The closed hair bow maker 1 creates a fold pattern and center line point for the folded ribbon 100, which allows a user to properly secure the center line with a tie-off material 102 and perfectly crease the folded ribbon 100. The tie-off material 102 may be yarn, string, ribbon or any suitable material. The folded ribbon 100 may also be sewn with thread or the like instead of being tied with the tie-off material 102. A completed bow 104 is then removed by removing the elastic strap 24 and opening the hair bow maker 1.

With reference to FIGS. 11-15, a fourth embodiment of the hair bow maker 4 is shown. The hair bow maker 4 includes two jaw members 78 and a flat torsion spring 80. Each jaw member preferably includes a base section 82, a first leg section 84 and a second leg section 86. A tie slot 85 is formed by the first and second leg sections. A first plurality of teeth 88 extend outward from each side of the first leg section 84. A second plurality of teeth 90 extend outward from each side of the second leg section 86. Two rows of first teeth are created by the first plurality of teeth 88 and two rows of second teeth are created by the second plurality of teeth 90. The first plurality of teeth 88 mesh with the second plurality of teeth 90.

It is preferably to have a gap "G" formed between at least three first few teeth 88, 90. The gap "G" gradually becomes smaller with successive teeth, until the gap "G" disappears completely. The gap "G" aids in creasing a folded ribbon 100. The plurality of teeth 88, 90 are disclosed as having a triangular shape, but could be any other appropriate shape. A low friction coating may be applied to the plurality of teeth 88, 90 to allow a ribbon to be pulled therethrough with greater ease. The plurality of teeth 88, 90 may be replaced with a flat surface, similar to that shown in FIG. 6*a*.

A peripheral flange 92 extends outward from the base section 82. A pivot projection 94 extends outward from one side of the peripheral flange 92. A pivot projection receiver 95 is formed in the other side of the peripheral flange 92 to receive the pivot projection 94. A pivot pin 96 extends inward from the pivot projection 94. A pivot post 98 extends outward from the base section 82, adjacent the other side of the peripheral flange 92. A pivot hole 110 is formed through a top of the pivot post 98 to receive the pivot pin 96 from a second jaw member 78. A spring post 112 extends from the base section 82. A post hole 114 is formed in each end of the flat torsion spring 80 to receive the spring post 112. The two jaw members 78 are assembled to each other by inserting the two pivot pins 96 into the two pivot holes 110. The two spring posts 112 are inserted into the two post holes 114 and the spring posts 112 heated to retain the flat torsion spring 80 in the two jaw members 78. The flat torsion spring 80 prevents axial movement of the two jaw members 78 relative to the pivot pins 96.

With reference to FIGS. 4-5, a folded ribbon 100 (not shown) is inserted between the two jaw members 78. The flat torsion spring 80 forces the two jaw members together 78. The plurality of teeth 88, 90 create a creasing pattern in the folded ribbon 100 and also clamp the folded ribbon 100. The folded ribbon 100 may be tied-off by inserting the tie-off material 102 (not shown) into the tie slot 85. A completed bow 104 (not shown) is then removed by squeezing the base sections 82 of the jaw members 78 toward each other.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of forming a hair bow, comprising the steps of:

providing a first jaw and a second jaw;

forming a first slot through said first jaw and a second slot through said second jaw, forming a plurality of first teeth on an inside surface of said first jaw and a plurality of second teeth on an inside surface of said second jaw, said plurality of first teeth being received by said plurality of second teeth;

providing means for forcing said first and second jaws together;

placing a ribbon between an inside surface of said first and second jaws, a middle portion of the ribbon being substantially located within said first and second slots; and tying a tie-off material around substantial the middle portion of the ribbon.

2. The method of forming a hair bow of claim 1, further comprising the step of:

providing at least one elastic strap for said means for forcing said first and second jaws together.

3. The method of forming a hair bow of claim 1, further comprising the step of:

providing at least one spring for said means for forcing said first and second jaws together.

4. The method of forming a hair bow of claim 1, further comprising the step of:

forming a gap between at least three first teeth of said first and second plurality of teeth.

5. The method of forming a hair bow of claim 4, further comprising the step of:

making said gap gradually smaller with each successive tooth of said plurality of first and second plurality of teeth, until said gap substantially disappears.

6. A method of forming a hair bow, comprising the steps of:

providing a first jaw and a second jaw;

forming a first slot through said first jaw and a second slot through said second jaw, forming a plurality of first teeth on an inside surface of said first jaw and a plurality of second teeth on an inside surface of said second jaw, said plurality of first teeth being received by said plurality of second teeth;

engaging pivotally one end of said first jaw with one end of said second jaw;

providing means for forcing said first and second jaws together;

placing a ribbon between an inside surface of first and second jaws, a middle portion of the ribbon being substantially located within said first and second slots; and tying a tie-off material around substantial the middle portion of the ribbon.

7. The method of forming a hair bow of claim 6, further comprising the step of:

providing at least one elastic strap for said means for forcing said first and second jaws together.

8. The method of forming a hair bow of claim 6, further comprising the step of:

providing at least one spring for said means for forcing said first and second jaws together.

9. The method of forming a hair bow of claim 6, further comprising the step of:

creating two rows of first teeth in said first plurality of teeth and creating two rows of second teeth in said second plurality of teeth.

10. The method of forming a hair bow of claim 6, further comprising the step of:

forming a gap between at least three first teeth of said first and second plurality of teeth.

11. The method of forming a hair bow of claim 10, further comprising the step of:

making said gap gradually smaller with each successive tooth of said plurality of first and second plurality of teeth, until said gap substantially disappears.

12. A method of forming a hair bow, comprising the steps of:

providing a first jaw and a second jaw;

forming a first slot through said first jaw and a second slot through said second jaw, forming a plurality of first teeth on an inside surface of said first jaw and a plurality of second teeth on an inside surface of said second jaw, said plurality of first teeth being received by said plurality of second teeth, creating two rows of first teeth in said first plurality of teeth and creating two rows of second teeth in said second plurality of teeth;

providing means for forcing said first and second jaws together;

placing a ribbon between an inside surface of said first and second jaws, a middle portion of the ribbon being substantially located within said first and second slots; and tying a tie-off material around substantial the middle portion of the ribbon.

13. The method of forming a hair bow of claim 12, further comprising the step of:

providing at least one elastic strap for said means for forcing said first and second jaws together.

14. The method of forming a hair bow of claim 12, further comprising the step of:

providing at least one spring for said means for forcing said first and second jaws together.

15. The method of forming a hair bow of claim 12, further comprising the step of:

forming a gap between at least three first teeth of said first and second plurality of teeth.

16. The method of forming a hair bow of claim 15, further comprising the step of:

making said gap gradually smaller with each successive tooth of said plurality of first and second plurality of teeth, until said gap substantially disappears.

* * * * *